US005819661A

United States Patent [19]

Lewis et al.

[11] Patent Number: 5,819,661

[45] Date of Patent: Oct. 13, 1998

[54] METHOD AND APPARATUS FOR LASER IMAGING OF LITHOGRAPHIC PRINTING MEMBERS BY THERMAL NON-ABLATIVE TRANSFER

[75] Inventors: Thomas E. Lewis, E. Hampstead; Kenneth R. Cassidy, Goffstown, both of N.H.

[73] Assignee: Presstek, Inc., Hudson, N.H.

[21] Appl. No.: 376,766

[22] Filed: Jan. 23, 1995

[51] Int. Cl.[6] ..... B41C 1/10

[52] U.S. Cl. ..... 101/467; 101/454; 101/457; 101/456

[58] Field of Search ..... 101/453, 454, 101/457, 462, 463.1, 465, 466, 467, 401.1, 456

[56] References Cited

U.S. PATENT DOCUMENTS

| | | | |
|---|---|---|---|
| 3,472,162 | 10/1969 | Newman et al. | 101/463.1 |
| 3,580,719 | 5/1971 | Brinckman | 101/470 |
| 3,736,873 | 6/1973 | Newman | 101/467 |
| 3,745,586 | 7/1973 | Braudy | 101/471 |
| 3,816,659 | 6/1974 | Landsman | 358/491 |
| 3,945,318 | 3/1976 | Landsman | 101/467 |
| 3,962,513 | 6/1976 | Eames | 101/470 |
| 3,964,389 | 6/1976 | Peterson | 101/467 |
| 4,245,003 | 1/1981 | Oransky et al. | 101/401.1 |
| 4,588,674 | 5/1986 | Stewart et al. | 430/273 |
| 4,711,834 | 12/1987 | Butters et al. | 430/201 |
| 4,846,065 | 7/1989 | Mayrhofer et al. | 101/453 |
| 5,045,697 | 9/1991 | Schneider | 250/316.1 |
| 5,129,321 | 7/1992 | Fadner | 101/465 |
| 5,132,723 | 7/1992 | Gelbart | 355/41 |
| 5,156,938 | 10/1992 | Foley et al. | 430/200 |
| 5,171,650 | 12/1992 | Ellis et al. | 430/201 |
| 5,238,778 | 8/1993 | Hirai et al. | 101/467 |
| 5,308,737 | 5/1994 | Bills et al. | 430/201 |
| 5,326,619 | 7/1994 | Dower et al. | 428/164 |
| 5,340,693 | 8/1994 | Uytterhoeven et al. | 430/253 |
| 5,342,731 | 8/1994 | Kelly et al. | 430/253 |
| 5,360,781 | 11/1994 | Leenders et al. | 430/200 |
| 5,382,964 | 1/1995 | Schneider | 101/467 |
| 5,395,729 | 3/1995 | Reardon et al. | 430/200 |
| 5,460,918 | 10/1995 | Ali et al. | 101/453 |

FOREIGN PATENT DOCUMENTS

| | | | |
|---|---|---|---|
| 108512 | 9/1978 | Japan | 101/467 |
| 126104 | 10/1979 | Japan | 101/467 |
| 13168 | 2/1981 | Japan | 101/467 |
| 323592 | 12/1993 | Japan . | |
| 2176018 | 12/1986 | United Kingdom . | |
| 94/25282 | 11/1994 | WIPO . | |

OTHER PUBLICATIONS

Levene, M.L. et al. *Applied Optics 9*:2260 (1970).
Braudy, Robert S., *J. Appl. Phys. 45*:3512 (1974).
Pinto, 38 *J. Imaging Sci. and Tech.* 565 (1994).

*Primary Examiner*—Stephen R. Funk
*Attorney, Agent, or Firm*—Cesari and McKenna, LLP

[57] ABSTRACT

Apparatus and methods for rapid, efficient production of durable lithographic printing plates by a thermal-transfer process that does not involve ablation. In response to an imaging pulse, a transfer material reduces in viscosity to a flowable state. The material exhibits a higher melt adhesion for a plate substrate than for the carrier sheet to which it is initially bound, so that in a flowable state it transfers completely to the substrate. Following transfer, the carrier sheet, along with untransferred material, is removed from the substrate.

32 Claims, 11 Drawing Sheets

METHOD AND APPARATUS FOR LASER IMAGING OF LITHOGRAPHIC PRINTING MEMBERS BY THERMAL NON-ABLATIVE TRANSFER

BACKGROUND OF THE INVENTION

1. Field of the Invention

The present invention relates to digital printing apparatus and methods, and more particularly to a system for imaging lithographic printing plates on- or off-press using digitally controlled laser output.

2. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing cylinders, in contrast, contain series of wells or indentations that accept ink for deposit onto the recording medium; excess ink must be removed from the cylinder by a doctor blade or similar device prior to contact between the cylinder and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording material; the plate first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-abhesive fountain solution prevents ink from adhering to the non-image, areas, but does not affect the oleophilic character of the image areas.

If a press is to print in more than one color, a separate printing plate corresponding to each color is required, each such plate usually being made photographically as described below. In addition to preparing the appropriate plates for the different colors, the operator must mount the plates properly on the plate cylinders of the press, and coordinate the positions of the cylinders so that the color components printed by the different cylinders will be in register on the printed copies. Each set of cylinders associated with a particular color on a press is usually referred to as a printing station.

In most conventional presses, the printing stations are arranged in a straight or "in-line" configuration, as described, for example, in U.S. Pat. No. 5,163,368 (co-owned with the present application and hereby incorporated by reference). Each printing station typically includes an impression cylinder, a blanket cylinder, a plate cylinder and the necessary ink (and, in wet systems, dampening) assemblies. The recording material is transferred among the print stations sequentially, each station applying a different ink color to the material to produce a composite multi-color image. Another configuration, described in U.S. Pat. No. 4,936,211 (co-owned with the present application and hereby incorporated by reference), relies on a central impression cylinder that carries a sheet of recording material past each print station, eliminating the need for mechanical transfer of the medium to each print station.

With either type of press, the recording medium can be supplied to the print stations in the form of cut sheets or a continuous "web" of material. The number of print stations on a press depends on the type of document to be printed. For mass copying of text or simple monochrome line-art, a single print station may suffice. To achieve full tonal rendition of more complex monochrome images, it is customary to employ a "duotone" approach, in which two stations apply different densities of the same color or shade. Full-color presses apply ink according to a selected color model, the most common being based on cyan, magenta, yellow and black (the "CMYK" model). Accordingly, the CMYK model requires a minimum of four print stations; more may be required if a particular color is to be emphasized. The press may contain another station to apply spot lacquer to various portions of the printed document, and may also feature one or more "perfecting" assemblies that invert the recording medium to obtain two-sided printing.

The plates for an offset press have traditionally been produced photographically. To prepare a wet plate using a typical negative-working subtractive process, the original document is photographed to produce a photographic negative. This negative is placed on an aluminum plate having a water-receptive oxide surface coated with a photopolymer. Upon exposure to light or other radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), exposing the hydrophilic surface of the aluminum plate.

A similar photographic process is usually employed to create dry plates as well. These ordinarily include an ink-abhesive (e.g., silicone) surface layer coated onto a photosensitive layer, which is itself coated onto a substrate of suitable stability (e.g., an aluminum sheet). Upon exposure to actinic radiation, the photosensitive layer cures to a state that destroys its bonding to the surface layer. After exposure, a treatment is applied to deactivate the photoresponse of the photosensitive layer in unexposed areas and to further improve anchorage of the surface layer to these areas. Immersion of the exposed plate in developer results in dissolution and removal of the surface layer at those portions of the plate surface that have received radiation, thereby exposing the ink-receptive, cured photosensitive layer.

Photographic platemaking processes tend to be time-consuming and require facilities and equipment adequate to support the necessary chemistry. To circumvent these shortcomings, practitioners have developed a number of electronic alternatives to plate imaging, some of which can be utilized on-press. With these systems, digitally controlled devices alter the ink-receptivity of blank plates in a pattern representative of the image to be printed. Such imaging devices include sources of electromagnetic-radiation pulses, produced by one or more laser or non-laser sources, that create chemical changes on plate blanks (thereby eliminating the need for a photographic negative); ink-jet equipment that directly deposits ink-repellent or ink-accepting spots on plate blanks; and spark-discharge equipment, in which an electrode in contact with or spaced close to a plate blank produces electrical sparks to physically alter the topology of the plate blank, thereby producing "dots" which collectively form a desired image (see, e.g., U.S. Pat. No. 4,911,075, co-owned with the present application and hereby incorporated by reference).

Because of the ready availability of laser equipment and their amenability to digital control, significant effort has been devoted to the development of laser-based imaging systems. Early examples utilized lasers to etch away material from a plate blank to form an intaglio or letterpress pattern. See, e.g., U.S. Pat. Nos. 3,506,779; 4,347,785. This approach was later extended to production of lithographic plates, e.g., by removal of a hydrophilic surface to reveal an oleophilic underlayer. See. e.g., U.S. Pat. No. 4,054,094. These systems generally require high-power lasers, which are expensive and slow.

A second approach to laser imaging involves the use of transfer materials. See, e.g., U.S. Pat. Nos. 3,945,318; 3,962,513; 3,964,389; 4,245,003; 4,395,946; 4,588,674; and 4,711,834. With these systems, a polymer sheet transparent to the radiation emitted by the laser is coated with a transferable material. During operation the transfer side of this construction is brought into contact with an acceptor sheet, and the transfer material is selectively irradiated through the transparent layer. Typically, the transfer material exhibits a high degree of absorbence for imaging laser radiation, and ablates—that is, virtually explodes into a cloud of gas and charred debris—in response to a laser pulse. This action, which may be further enhanced by self-oxidation (as in the case, for example, of nitrocellulose materials), ensures complete removal of the transfer material from its carrier. Material that survives ablation adheres to the acceptor sheet.

Alternatively, instead of laser activation, transfer of the thermal material can be accomplished through direct contact. U.S. Pat. No. 4,846,065, for example, describes the use of a digitally controlled pressing head to transfer oleophilic material to an image carrier.

Regardless of the actual transfer mechanism, the transfer and acceptor materials ordinarily exhibit different affinities for fountain solution and/or ink, so that removal of the transparent layer together with unirradiated transfer material leaves a suitably imaged, finished plate. Typically, the transfer material is oleophilic and the acceptor material hydrophilic. Unfortunately, plates produced with transfer-type systems tend to exhibit performance limitations associated with uneven material transfer. This contributes, for example, to the short useful lifetimes exhibited by transfer-type plates (although this problem probably derives primarily from transfer of degraded, partially ablated materials).

Uneven material transfer is explained, at least in part, by the formation of gas pockets during the ablation process. This effect is illustrated in FIGS. 1A–1C. A representative donor transfer blank, indicated generally by reference numeral 30, includes an aluminum plate substrate 32 and a transfer sheet held in intimate contact with substrate 32. The transfer sheet comprises a carrier film layer 34 that is substantially transparent to imaging radiation and, bonded to carrier layer 34, a transfer layer 36 that responds to imaging radiation. As shown in FIG. 1A, an imaging pulse 38 from a laser source strikes transfer blank 30 and spans a diameter indicated by boundaries A and B. The intense heating of layer 36 caused by the laser beam at least partially ablates layer 36 within the imaging zone A–B, resulting in production of gases that gather into a pocket 40 (see FIG. 1B) and lift the transfer blank away from substrate 32. The beam also results in transfer to substrate 32 of a slug 42 of transfer material; the transfer is incomplete, however, partly as a result of interference by gas pocket 40.

The gases in pocket 40 can continue to spread well beyond the imaging zone A–B, as shown in FIG. 1C, lifting even more of the transfer blank away from substrate 32 across a region that now spans boundaries A to C. The disruption of the contact between the donor transfer blank (layers 34, 36) and substrate 32 further degrades imaging capability in the as-yet-unexposed region B–C. In other words, laser-induced transfer of material at one site—incomplete in itself as a result of gas-pocket formation—causes adjacent regions to become even less responsive to subsequent laser exposure. The overall result is partial and inconsistent transfer of material across the blank. This behavior manifests itself in final plate images of varying quality, durability and adhesion which, when employed in commercial printing environments requiring 50,000 or more impresssions, remain vulnerable to degradation. Indeed, image degradation through the course of plate usage represents a common problem with virtually all transfer-type processes, since the transfer material remains bound to the substrate by relatively weak adhesion forces.

DESCRIPTION OF THE INVENTION

Brief Summary of the Invention

The present invention facilitates rapid, efficient production of durable lithographic printing plates by a radiation-induced thermal-transfer process. Unlike well-known prior-art systems, however, the invention deliberately avoids ablation as a transfer mechanism. Instead, in response to an imaging radiation pulse, our transfer material reduces in viscosity to a flowable state. The material is formulated to exhibit a higher melt adhesion for a plate substrate than for the carrier sheet to which it is initially bound, so that in a flowable state it transfers completely to the substrate. Following transfer, the carrier sheet, along with untransferred material, is removed from the substrate.

The transferred material is then subjected to a fusing step. Unlike the prior art, which relies on a short exposure to both transfer and fix the donor material onto the acceptor sheet, the fusing step chemically and/or physically anchors our transfer material onto the substrate, resulting in enhanced adhesion properties. Moreover, since the constructions may be imaged while on-press, the fusing step imposes little additional processing burden or mechanical requirements.

The present invention preferably employs, as imaging devices, relatively inexpensive laser equipment that operates at low to moderate power levels. However, other digitally controllable approaches to delivering imaging radiation (e.g., light valving, as described, for example, in U.S. Pat. Nos. 4,577,932; 4,743,091; 5,049,901; and 5,132,723, the entire disclosures of which are hereby incorporated by reference) can be used instead, and may in fact prove preferable for off-press applications. In one implementation, the invention employs imaging apparatus including at least one laser device that emits in the IR, and preferably near-IR region; as used herein, "near-IR" means imaging radiation whose $lambda_{max}$ lies between 700 and 1500 nm. The present invention can employ solid-state lasers (commonly termed semiconductor lasers and typically based on gallium aluminum arsenide compounds) as sources; these are distinctly economical and convenient, and may be used in conjunction with a variety of imaging devices. The use of near-IR radiation facilitates use of a wide range of organic and inorganic absorption compounds that facilitate imaging and, in particular, semiconductive and conductive compounds.

The imaging techniques described herein can be used in conjunction with a variety of plate-blank constructions, enabling production of "wet" plates that utilize fountain solution during printing or "dry" plates to which ink is applied directly. As used herein, the term "plate" or "member" refers to any type of printing medium or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder, as exemplified in U.S. Pat. No. 5,440,987, entitled LASER IMAGED SEAMLESS OFFSET LITHOGRAPHIC PRINTING MEMBERS AND METHOD OF MAKING, the entire disclosure of which is hereby incorporated by reference), an endless belt, or other arrangement.

In one embodiment, the substrate is a textured hydrophilic metal (e.g., chromium or grain-anodized aluminum, as described in U.S. Pat. Nos. 4,911,075 and 4,958,563, the disclosures of which are hereby incorporated by reference), and the transfer material is an oleophilic, hydrophobic polymer that becomes flowable in response to imaging radiation. Upon exposure, the transfer material decreases in viscosity and develops adhesion with the substrate surface; at this point, as with conventional processes, contact between the transfer material and the substrate is largely limited to elevated texture peaks. Following complete imagewise exposure of the plate, the untransferred material is removed, and the transferred material is thermally fused into the substrate texture. Specifically, the imaged construction is heated to raise the temperature of the transferred polymer (e.g., above the glass-transition point $T_g$) so that it re-enters a flowable state; the heated polymer soaks into the porosity of the substrate, becoming firmly bound therein. When the finished plate cools and the polymer solidifies, its mechanical and chemical adhesion to the plate surface will be substantial and the plate will exhibit commensurate durability. Moreover, because the polymer has become integrated within the substrate texture, the plate will continue to function even if the layer of polymer overlying the plate surface wears away: interstitial material, which remains virtually impervious to extraction from the surface within which it is bound, will continue to defeat the natural hydrophilicity of that surface.

In a second embodiment, the fusing mechanism is chemical in addition to or instead of thermal. Although the approach of the first embodiment can be applied to non-metal surfaces, intimate bonding to weakly textured hydrophilic materials (such as films based on polyvinyl alcohol species) may be accomplished chemically more readily than physically. In these circumstances, instead of using heat fusion, the transfer material includes some form of delayed chemical reactivity that may be selectively triggered following deposition on the substrate, and which serves to anchor the material to that substrate. At the same time, chemical bonding can also be used to advantage in connection with textured metal substrates, either in lieu of or in addition to the mechanical fusing discussed above. Suitable chemical species, which desirably are chemically integrated into the polymer backbone of the transfer material, include carboxyl-functional groups (which adhere well to metal surfaces), condensation-cure and addition-cure functional groups, and radiation-curable groups.

The approach of the present invention can also be used to produce dry plates. In this case, the transfer material is oleophobic and the substrate oleophilic, or vice versa.

The transfer material is ordinarily disposed on a carrier sheet transparent to the imaging radiation; the carrier sheet is held in intimate contact with the substrate during imaging. In order to render the transfer material responsive to imaging radiation at relatively low power levels, the transfer material preferably contains a radiation-sensitive compound having an absorption peak at or near the imaging wavelength. The absorptive material may be a pigment or dye dispersed or dissolved in the polymer matrix, or a chromophore (such as phthalocyanine or naphthalocyanine, as described in U.S. Pat. No. 5,310,869 and the references cited therein) chemically integrated therewith.

Laser output is either provided directly to the plate surface via lenses or other beam-guiding components or transmitted to the surface of a blank printing plate from a remotely sited laser using a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor (RIP) or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for reasons of speed) to employ a plurality of lasers and guide their outputs to a single writing array. The writing array is then indexed, after completion of each pass across or along the plate, a distance determined by the number of beams emanating from the array, and by the desired resolution (i.e, the number of image points per unit length).

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

1. Imaging Apparatus a. Exterior-Drum Recording

Figure 1A:
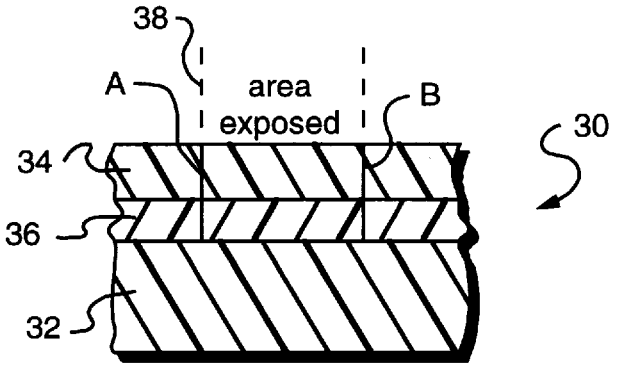
FIG. 1A PRIOR ART
FIGS. 1A–1C are elevational sections of prior-art, ablation-type plate blanks, showing their behavior in response to imaging radiation and the formation of gas pockets.
Figure 1B:
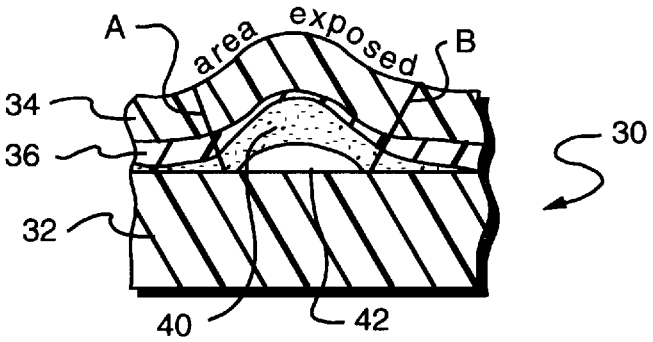
FIG. 1B PRIOR ART
Figure 1C:
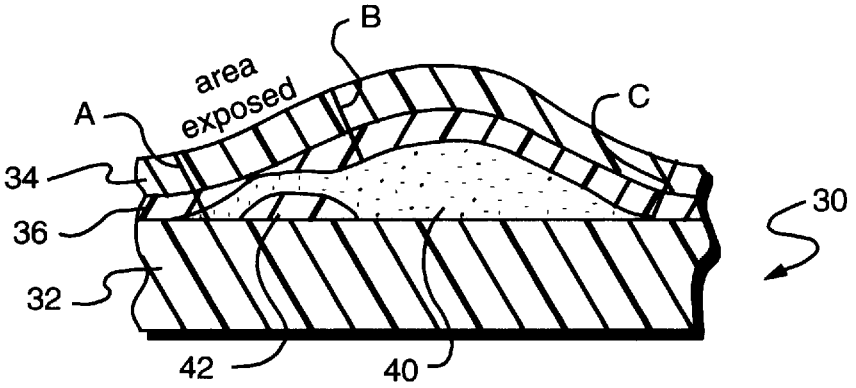
FIG. 1C PRIOR ART
Figure 2:
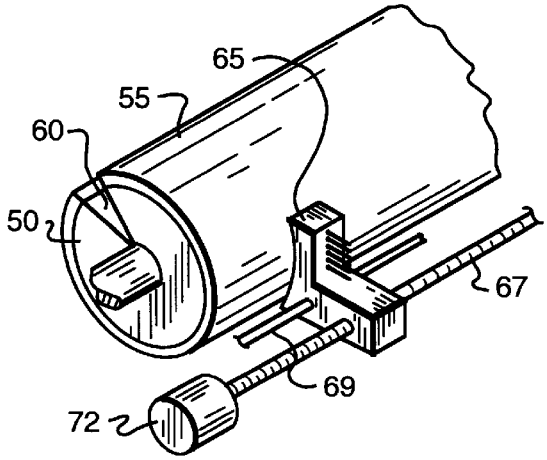
FIG. 2 is an isometric view of the cylindrical embodiment of an imaging apparatus in accordance with the present invention, and which operates in conjunction with a diagonal-array writing array.

Refer first to FIG. 2 of the drawings, which illustrates the exterior drum embodiment of our imaging system. The assembly includes a cylinder 50 around which is wrapped a lithographic plate blank 55. Cylinder 50 includes a void segment 60, within which the outside margins of plate 55 are secured by conventional clamping means (not shown). We note that the size of the void segment can vary greatly depending on the environment in which cylinder 50 is employed.

If desired, cylinder 50 is straightforwardly incorporated into the design of a conventional lithographic press, and serves as the plate cylinder of the press. In a typical press construction, plate 55 receives ink from an ink train, whose terminal cylinder is in rolling engagement with cylinder 50. The latter cylinder also rotates in contact with a blanket cylinder, which transfers ink to the recording medium. The press may have more than one such printing assembly arranged in a linear array. Alternatively, a plurality of assemblies may be arranged about a large central impression cylinder in rolling engagement with all of the blanket cylinders.

The recording medium is mounted to the surface of the impression cylinder, and passes through the nip between that cylinder and each of the blanket cylinders. Suitable central-impression and in-line press configurations are described in allowed application U.S. Pat. No. 5,163,368 (commonly owned with the present application and hereby incorporated by reference) and the '075 patent.

Figure 3:
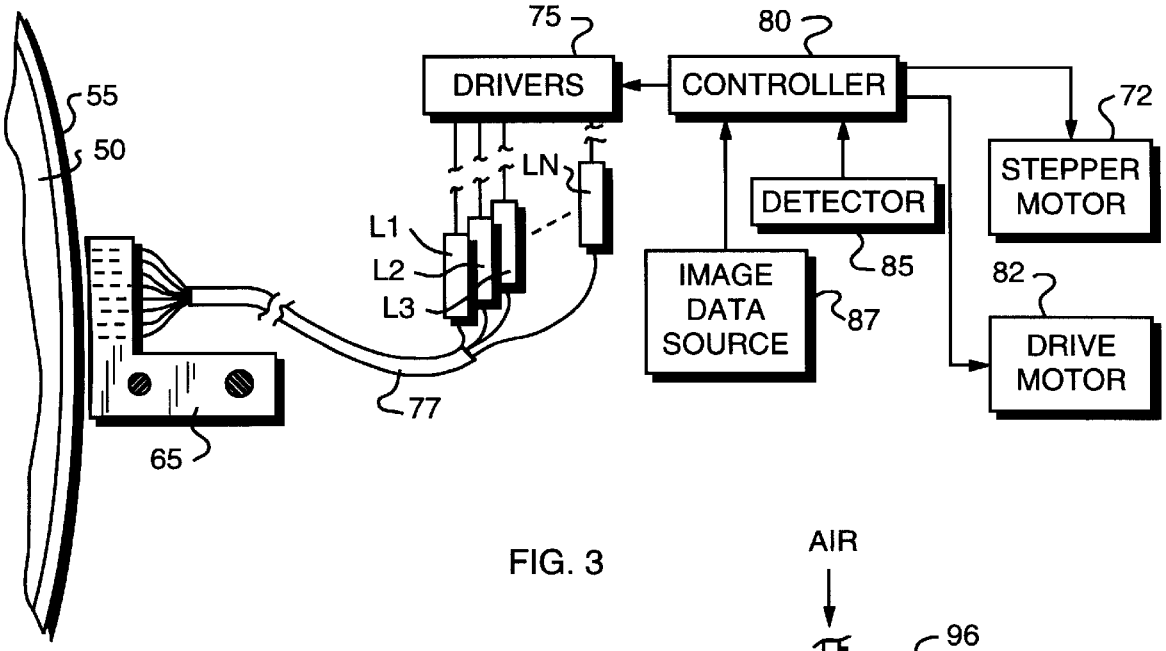
FIG. 3 is a schematic depiction of the embodiment shown in FIG. 2, and which illustrates in greater detail its mechanism of operation.

Cylinder 50 is supported in a frame and rotated by a standard electric motor or other conventional means (illustrated schematically in FIG. 3). The angular position of cylinder 50 is monitored by a shaft encoder (see FIG. 5). A writing array 65, mounted for movement on a lead screw 67 and a guide bar 69, traverses plate 55 as it rotates. Axial movement of writing array 65 results from rotation of a stepper motor 72, which turns lead screw 67 and thereby shifts the axial position of writing array 65. Stepper motor 72 is activated during the time writing array 65 is positioned over void 60, after writing array 65 has passed over the entire surface of plate 55. The rotation of stepper motor 72 shifts writing array 65 to the appropriate axial location to begin the next imaging pass.

The axial index distance between successive imaging passes is determined by the number of imaging elements in writing array 65 and their configuration therein, as well as by the desired resolution. As shown in FIG. 3, a series of laser sources $L_1$, $L_2$, $L_3$ . . . $L_n$, driven by suitable laser drivers collectively designated by reference numeral 75 (and discussed in greater detail below), each provide output to a fiber-optic cable. The lasers are preferably gallium-arsenide models, although any high-speed lasers that emit in the near infrared region can be utilized advantageously.

The size of an image feature (i.e., a dot, spot or area) and image resolution can be varied in a number of ways. The laser pulse must be of sufficient (but not excessive) power and duration to effect material transfer as described below. The final resolution or print density obtainable with a given-sized feature can be enhanced by overlapping image features (e.g., by advancing the writing array an axial distance smaller than the diameter of an image feature).

Image-feature overlap expands the number of gray scales achievable with a particular feature.

The final plates should be capable of delivering at least 1,000, and preferably at least 50,000 printing impressions. This requires fabrication from durable material, and imposes certain minimum power requirements on the laser sources. For a laser to be capable of imaging the plates described below, its power density preferably falls in the range of 0.2 megawatt/in$^2$ to 0.6 megawatt/in$^2$.

Because preferred feature sizes are ordinarily quite small —on the order of 0.2 to 1.4 mils—the necessary power intensities are readily achieved even with lasers having moderate output levels (on the order of about 1 watt); a focusing apparatus, as discussed below, concentrates the entire laser output onto the small feature, resulting in high effective energy densities.

The cables that carry laser output are collected into a bundle 77 and emerge separately into writing array 65. It may prove desirable, in order to conserve power, to maintain the bundle in a configuration that does not require bending above the fiber's critical angle of refraction (thereby maintaining total internal reflection); however, we have not found this necessary for good performance.

Also as shown in FIG. 3, a controller 80 actuates laser drivers 75 when the associated lasers reach appropriate points opposite plate 55, and in addition operates stepper motor 72 and the cylinder drive motor 82. Laser drivers 75 should be capable of operating at high speed to facilitate imaging at commercially practical rates. The drivers preferably include a pulse circuit capable of generating at least 40,000 laser-driving pulses/second, with each pulse being relatively short, i.e., on the order of 1–15 $\mu$sec (although pulses of both shorter and longer durations have been used with success). A suitable design is described below.

Controller 80 receives data from two sources. The angular position of cylinder 50 with respect to writing array 65 is constantly monitored by a detector 85 (described in greater detail below), which provides signals indicative of that position to controller 80. In addition, an image data source 87 (e.g., a computer) also provides data signals to controller 80. The image data define points on plate 55 where image spots are to be written. Controller 80, therefore, correlates the instantaneous relative positions of writing array 65 and plate 55 (as reported by detector 85) with the image data to actuate the appropriate laser drivers at the appropriate times during scan of plate 55. The control circuitry required to implement this scheme is well-known in the scanner and plotter art; a suitable design is described in U.S. Pat. No. 5,174,205, commonly owned with the present application and hereby incorporated by reference.

Figure 4:
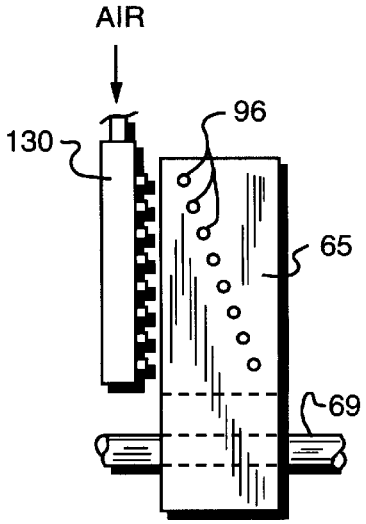
FIG. 4 is a front-end view of a writing array for imaging in accordance with the present invention, and in which imaging elements are arranged in a diagonal array.

The laser output cables terminate in lens assemblies, mounted within writing array 65, that precisely focus the beams onto the surface of plate 55. A suitable lens-assembly design is described below; for purposes of the present discussion, these assemblies are generically indicated by reference numeral 96. The manner in which the lens assemblies are distributed within writing array 65, as well as the design of the writing array, require careful design considerations. One suitable configuration is illustrated in FIG. 4. In this arrangement, lens assemblies 96 are staggered across the face of body 65. The design preferably includes an air manifold 130, connected to a source of pressurized air and containing a series of outlet ports aligned with lens assemblies 96. Introduction of air into the manifold and its discharge through the outlet ports cleans the lenses of debris during operation, and also purges fine-particle aerosols and mists from the region between lens assemblies 96 and plate surface 55. Alternatively, a single lens placed in front the output-cable termini (staggered as shown in FIG. 4) can be used to focus them all onto the surface of plate 55.

The staggered lens design facilitates use of a greater number of lens assemblies in a single head than would be possible with a linear arrangement. And since imaging time depends directly on the number of lens elements, a staggered design offers the possibility of faster overall imaging. Another advantage of this configuration stems from the fact that the diameter of the beam emerging from each lens assembly is ordinarily much smaller than that of the focusing lens itself. Therefore, a linear array requires a relatively significant minimum distance between beams, and that distance may well exceed the desired printing density. This results in the need for a fine stepping pitch. By staggering the lens assemblies, we obtain tighter spacing between the laser beams and, assuming the spacing is equivalent to the desired print density, can therefore index across the entire axial width of the array. Controller 80 either receives image data already arranged into vertical columns, each corresponding to a different lens assembly, or can progressively sample, in columnar fashion, the contents of a memory buffer containing a complete bitmap representation of the image to be transferred. In either case, controller 80 recognizes the different relative positions of the lens assemblies with respect to plate 55 and actuates the appropriate laser only when its associated lens assembly is positioned over a point to be imaged.

Figure 5:
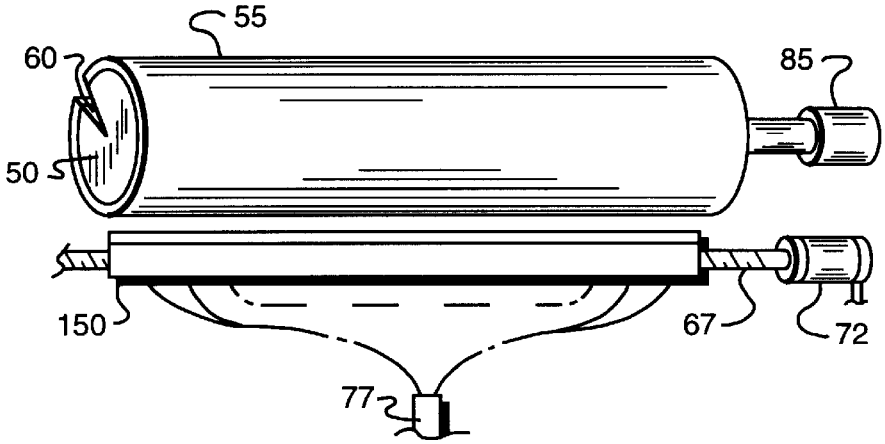
FIG. 5 is an isometric view of the cylindrical embodiment of an imaging apparatus in accordance with the present invention, and which operates in conjunction with a linear-array writing array.
Figure 6:
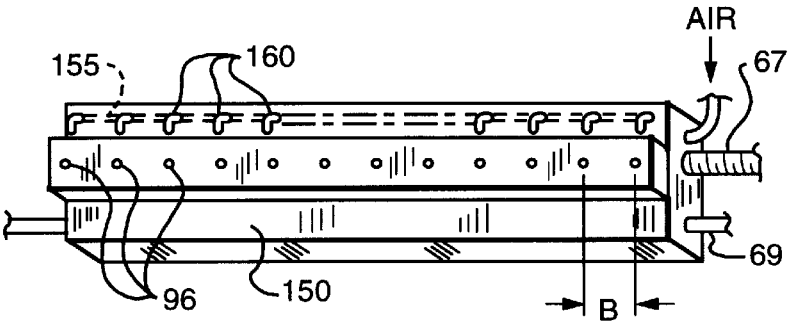
FIG. 6 is an isometric view of the front of a writing array for imaging in accordance with the present invention, and in which imaging elements are arranged in a linear array.
Figure 7:
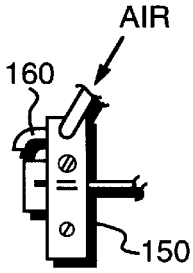
FIG. 7 is a side view of the writing array depicted in FIG. 6.

An alternative array design is illustrated in FIG. 5, which also shows the detector 85 mounted to the cylinder 50. Preferred detector designs are described in the '205 patent. In this case the writing array, designated by reference numeral 150, comprises a long linear body fed by fiber-optic cables drawn from bundle 77. The interior of writing array 150, or some portion thereof, contains threads that engage lead screw 67, rotation of which advances writing array 150 along plate 55 as discussed previously. Individual lens assemblies 96 are evenly spaced a distance B from one another. Distance B corresponds to the difference between the axial length of plate 55 and the distance between the first and last lens assembly; it represents the total axial distance traversed by writing array 150 during the course of a complete scan. Each time writing array 150 encounters void 60, stepper motor 72 rotates to advance writing array 150 an axial distance equal to the desired distance between imaging passes (i.e., the print density). This distance is smaller by a factor of n than the distance indexed by the previously described embodiment (writing array 65), where n is the number of lens assemblies included in writing array 65.

Writing array 150 includes an internal air manifold 155 and a series of outlet ports 160 aligned with lens assemblies 96. Once again, these function to remove debris from the lens assemblies and imaging region during operation.

b. Flatbed Recording

Figure 8:
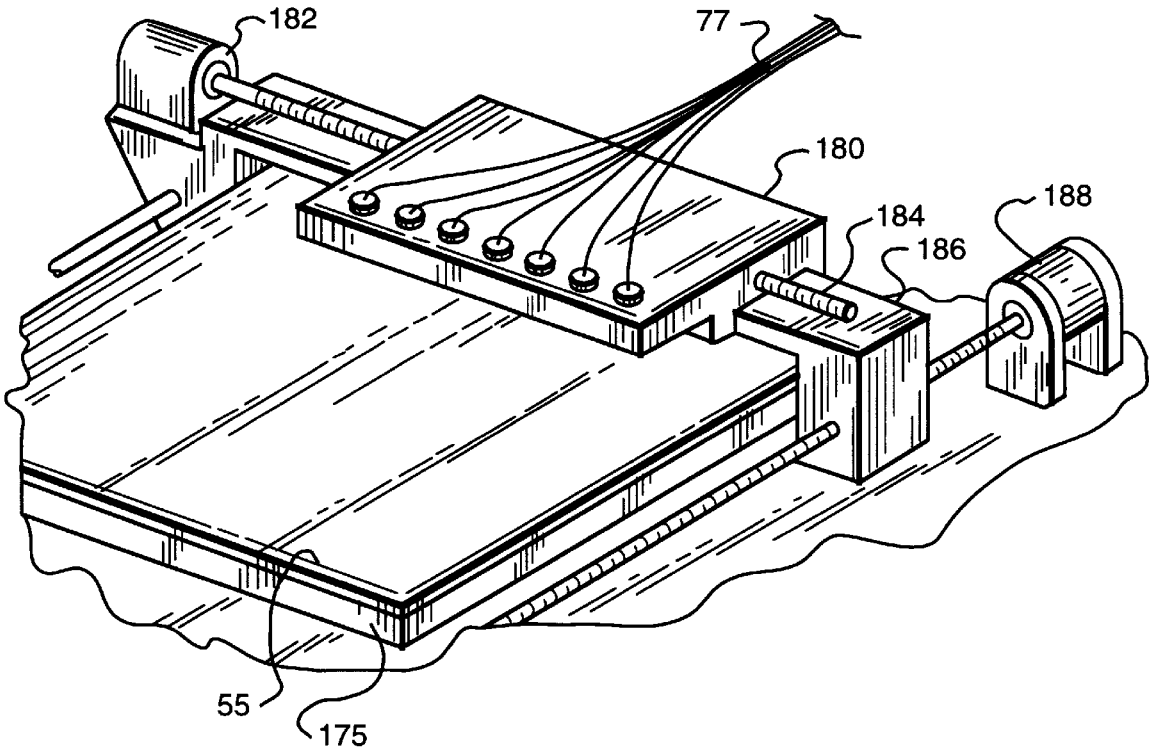
FIG. 8 is an isometric view of the flatbed embodiment of an imaging apparatus having a linear lens array.

The imaging apparatus can also take the form of a flatbed recorder, as depicted in FIG. 8. In the illustrated embodiment, the flatbed apparatus includes a stationary support 175, to which the outer margins of plate 55 are mounted by conventional clamps or the like. A writing array 180 receives fiber-optic cables from bundle 77, and includes a series of lens assemblies as described above. These are oriented toward plate 55.

A first stepper motor 182 advances writing array 180 across plate 55 by means of a lead screw 184, but now writing array 180 is stabilized by a bracket 186 instead of a guide bar. Bracket 186 is indexed along the opposite axis of support 175 by a second stepper motor 188 after each traverse of plate 55 by writing array 180 (along lead screw 184). The index distance is equal to the width of the image swath produced by imagewise activation of the lasers during the pass of writing array 180 across plate 55. After bracket 186 has been indexed, stepper motor 182 reverses direction and imaging proceeds back across plate 55 to produce a new image swath just ahead of the previous swath.

It should be noted that relative movement between writing array 180 and plate 155 does not require movement of writing array 180 in two directions. Instead, if desired, support 175 can be moved along either or both directions. It is also possible to move support 175 and writing array 180 simultaneously in one or both directions. Furthermore, although the illustrated writing array 180 includes a linear arrangement of lens assemblies, a staggered design is also feasible.

c. Interior-Arc Recording

Figure 9:
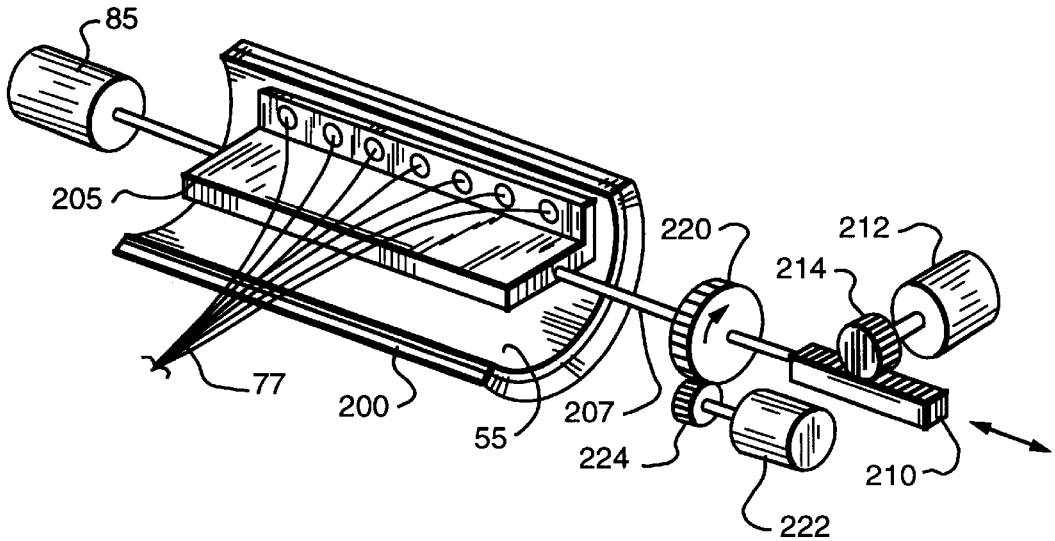
FIG. 9 is an isometric view of the interior-drum embodiment of an imaging apparatus having a linear lens array.

Instead of a flatbed, the plate blank can be supported on an arcuate surface as illustrated in FIG. 9. This configuration permits rotative, rather than linear movement of the writing array and/or the plate.

The interior-arc scanning assembly includes an arcuate plate support 200, to which a blank plate 55 is clamped or otherwise mounted. An L-shaped writing array 205 includes a bottom portion, which accepts a support bar 207, and a front portion containing channels to admit the lens assemblies. In the preferred embodiment, writing array 205 and support bar 207 remain fixed with respect to one another, and writing array 205 is advanced axially across plate 55 by linear movement of a rack 210 mounted to the end of support bar 207. Rack 210 is moved by rotation of a stepper motor 212, which is coupled to a gear 214 that engages the teeth of rack 210. After each axial traverse, writing array 205 is indexed circumferentially by rotation of a gear 220 through which support bar 207 passes and to which it is fixedly engaged. Rotation is imparted by a stepper motor 222, which engages the teeth of gear 220 by means of a second gear 224. Stepper motor 222 remains in fixed alignment with rack 210.

After writing array 205 has been indexed circumferentially, stepper motor 212 reverses direction and imaging proceeds back across plate 55 to produce a new image swath just ahead of the previous swath.

d. Output Guide and Lens Assembly

Figure 11:
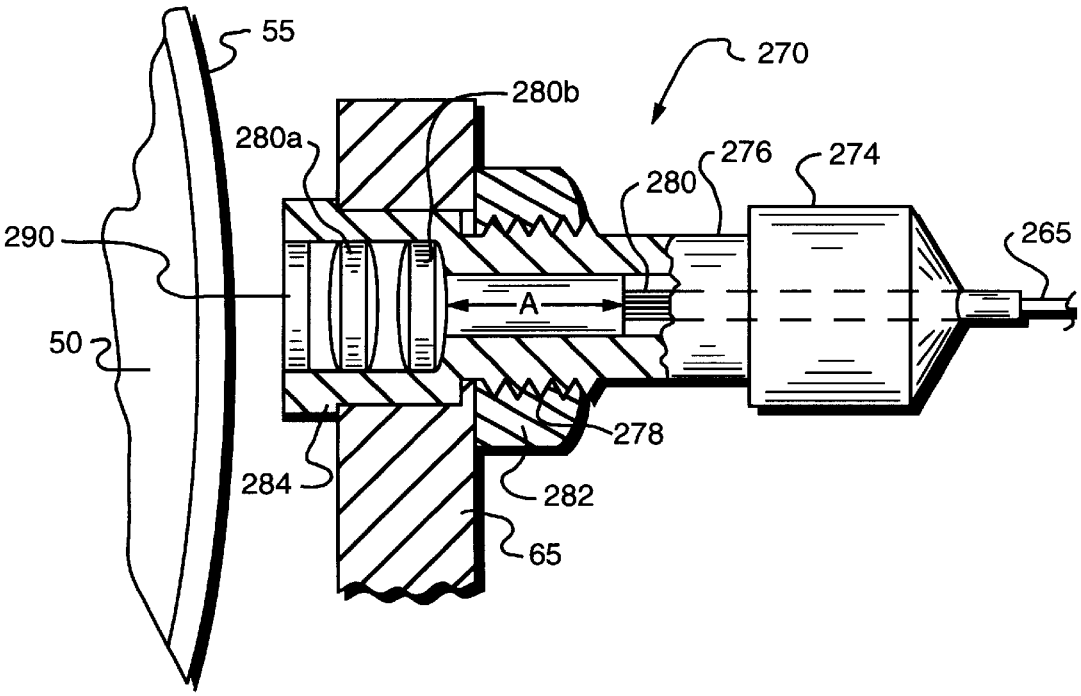
FIG. 11 is an enlarged, partial cutaway view of a lens element for focusing a laser beam from an optical fiber onto the surface of a printing plate.
Figure 10:
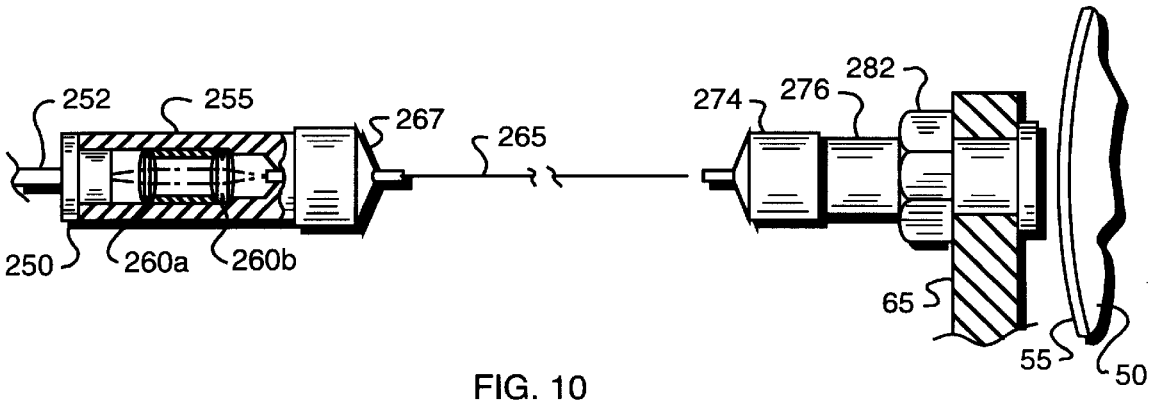
FIG. 10 is a cutaway view of a remote laser and beam-guiding system.
Figure 12:
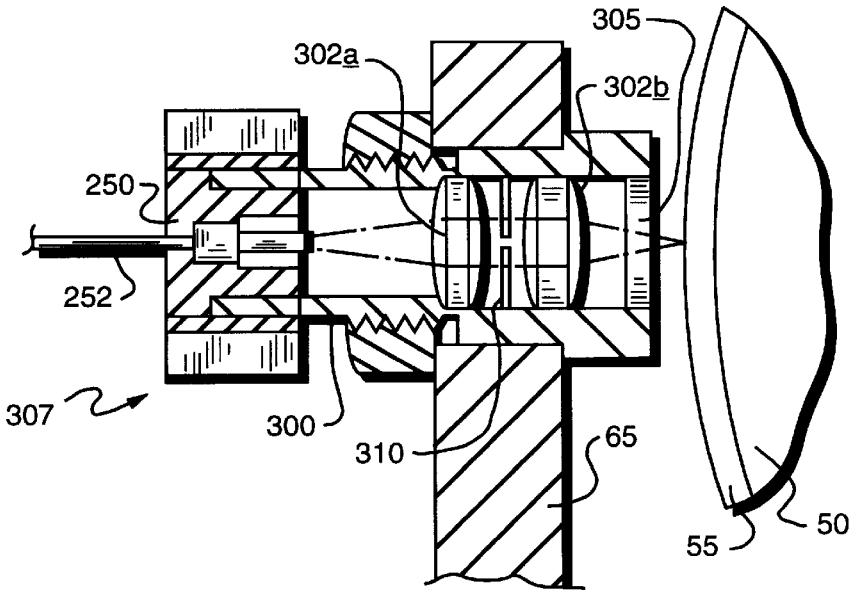
FIG. 12 is an enlarged, cutaway view of a lens element having an integral laser.

Suitable means for guiding laser output to the surface of a plate blank are illustrated in FIGS. 10–12. Refer first to FIG. 10, which shows a remote laser assembly that utilizes a fiber-optic cable to transmit laser pulses to the plate. In this arrangement a laser source 250 receives power via an electrical cable 252. Laser 250 is seated within the rear segment of a housing 255. Mounted within the forepart of housing are one or more focusing lenses 260*a*, 260*b*, which focus radiation emanating from laser 250 onto the end face of a fiber-optic cable 265, which is preferably (although not necessarily) secured within housing 255 by a removable retaining cap 267. Cable 265 conducts the output of laser 250 to an output assembly 270, which is illustrated in greater detail in FIG. 11.

Figure 13C:
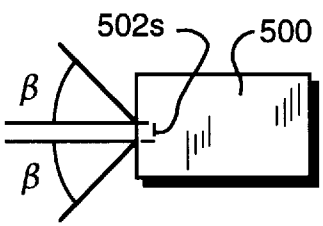
FIG. 13C is an elevation of the diode shown in FIG. 13A, showing the dispersion of radiation exiting therefrom along the other dimension.
Figure 13B:
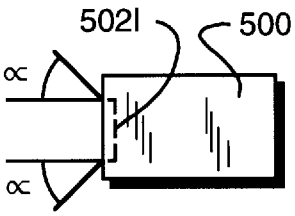
FIG. 13B is a plan view of the diode shown in FIG. 13A, showing the dispersion of radiation exiting therefrom along one dimension.
Figure 13A:
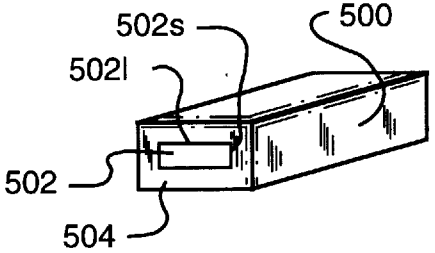
FIG. 13A is an isometric view of a typical laser diode.
Figure 14:
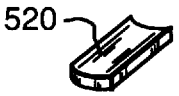
FIG. 14 illustrates a divergence-reduction lens for use in conjuncion with the laser diode shown in FIGS. 13A–13C.

The exemplary double-lens system shown in FIG. 10, while adequate in many arrangements, can be improved to accommodate the characteristics of typical laser diodes. FIG. 13A shows a common type of laser diode, in which radiation is emitted through a slit 502 in the diode face 504. The dimensions of slit 502 are specified along two axes, a long axis 502*l* and a short axis 502*s*. Radiation disperses as it exits slit 502, diverging at the slit edges. This is shown in FIGS. 13B and 13C. The dispersion around the short edges (i.e., along long axis 502*l*), as depicted in FIG. 13B (where diode 500 is viewed in plan), is defined by an angle $\alpha$; the dispersion around the long edges (i.e., along short axis 502*s*), as depicted in FIG. 13C (where diode 500 is viewed in elevation), is defined by an angle $\beta$. The numerical aperture (NA) of slit 502 along either axis is defined as the sine of the dispersion angle $\alpha$ or $\beta$.

For optimum performance, $\beta=\beta$ and the unitary NA is less than 0.3, and preferably less than 0.2. Small NA values correspond to large depths-of-focus, and therefore provide working tolerances that facilitate convenient focus of the radiation onto the end face of a fiber-optic cable. Without correction, however, these desirable conditions are usually impossible, even with special mask structures that have recently been applied to the multi-stripe and single-stripe semiconductor lasers useful in the present invention; laser diode 500 typically does not radiate at a constant angle, with divergence around the long edges exceeding that around the short edges, so $\beta>\alpha$.

Assuming that the NA along long axis 502*l* falls within acceptable limits, the NA along the short axis 502*s* can be made to approach the long-axis NA by controlling dispersion around the long edges. This is achieved using a divergence-reduction lens. Suitable configurations for such a lens include a cylinder (essentially a glass rod segment of proper diameter), a planoconvex bar, and the concave-convex trough shown in FIG. 15. The divergence-reduction lens is positioned adjacent slit 502 with its length following long axis 502*l*, and with its convex face adjacent the slit.

If the NA along long axis 502*l* also exceeds acceptable limits, the dispersion around the short edges can be diminished using a suitable condensing lens. In this case the optical characteristics of divergence-reduction lens 520 are chosen such that the NA along short axis 502*s* approaches that along long axis 502*l* after correction.

Advantageous use of a divergence-reduction lens is not limited to slit-type emission apertures. Such lenses can be usefully applied to any asymmetrical emission aperture in order to ensure even dispersion around its perimeter.

Preferably, the divergence-reduction lens has an antireflection coating to prevent radiation from rebounding and interfering with operation of diode 500 (for example, by causing the condition known as "mode hopping"). A practical manufacturing approach utilizes a facet coater to place an antireflection coating on the glass rod intended to serve as a cylindrical divergence-reduction lens. The coating, preferably a multilayer broad-band coating such as magnesium fluoride over titanium, is applied first along one half of the circumference and then along the other half. Overlap of the two applications is preferable to an uncoated gap. Therefore, to prevent transmission losses, the coated lens is oriented with respect to slit 502*s* such that radiation passes through lens regions have not been doubly coated; the opposed, doubly coated arc segments are positioned above and below the path of radiation emitted from diode 500. This positioning is straightforwardly obtained using known techniques of microscopic mechanical manipulation.

Figure 15:
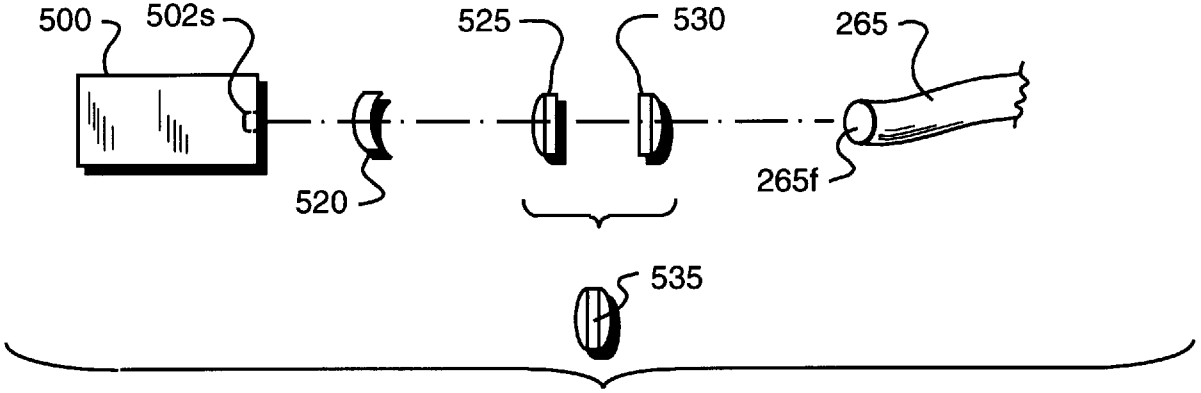
FIG. 15 schematically depicts a focusing arrangement that provides an alternative to the apparatus shown in FIG. 10.

With the radiation emitted through slit 502 fully corrected as described above, it can be straightforwardly focused onto the end face of a fiber-optic cable by a suitable optical arrangement, such as that illustrated in FIG. 15. The depicted optical arrangement utilizes a planoconvex bar as a divergence-reduction lens 520, which is oriented with respect to diode 500 as described above; a collimating lens 525, which draws the corrected but still divergent radiation into parallel rays; and an aspheric focusing lens 530, which focuses the parallel rays onto the end face 265*f* of fiber-optic cable 265. In some cases it is possible to replace lenses 525 and 530 with a custom aspheric lens 535 as shown.

Figure 16B:
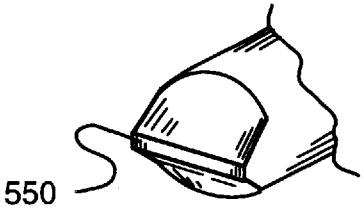
FIGS. 16A and 16B are side and end elevations of a chisel-edge end face of a fiber-optic cable.
Figure 17B:
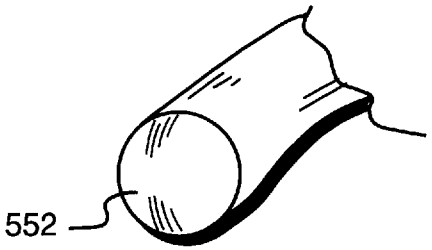
FIGS. 17A and 17B are side and end elevations of a hemispherical end face of a fiber-optic cable.
Figure 16A:
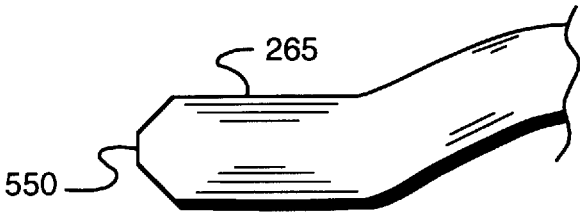
Figure 17A:
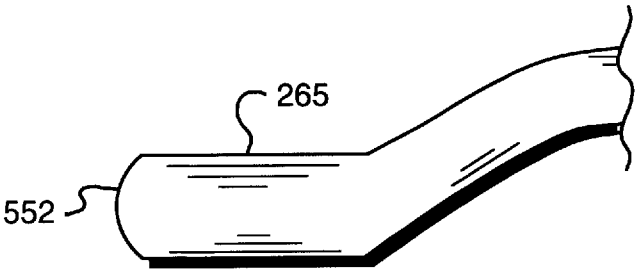

The face 265*f* of fiber-optic cable 265 can also be shaped to contribute to optical coupling or even to replace the collimating and focusing lenses entirely. For example, face 265*f* can be tapered by grinding into a flat chisel edge 550 that accepts beam radiation along a sufficiently narrow edge to avoid back reflection and consequent modal instability, as shown in FIGS. 16A and 16B. So long as the divergence of radiation emitted from slit 502 has been adequately reduced or controlled, the arrangement shown in FIGS. 16A and 16B will perform comparably to the separate lens configuration shown in FIG. 10. In another embodiment, illustrated in FIGS. 17A and 17B, the face of fiber-optic cable 265 is rounded into a hemisphere 552, again functioning to accept incoming radiation without mode hopping.

Figure 18:
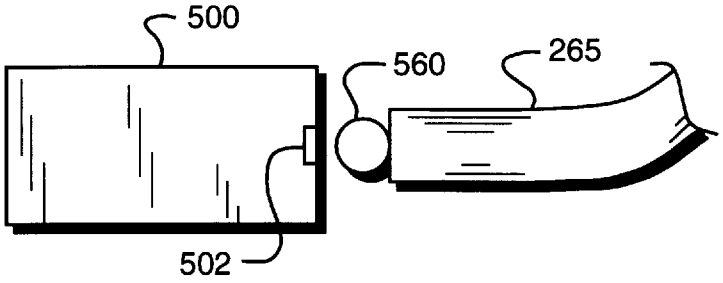
FIG. 18 is a side elevation of an optical-coupling arrangement that employs a cylindrical lens.

Another approach to optical coupling, which utilizes a cylindrical lens 560, appears in FIG. 18. As shown in the figure, cylindrical lens 560, which has received an antireflection coating, is interposed directly between slit 502 and a flat fiber face 265*f*, preferably in intimate contact with the fiber face and spaced slightly from the diode 500. Lens 560 reduces divergence around edges 502*l*, as discussed above, and focuses the laser beam onto face 265*f*.

In some arrangements, it may prove necessary or desirable to utilize a fiber with a flat face 265*f* that is smaller in diameter than the length of diode's large axis. Unless the the radiation emitted along the long axis is concentrated optically, the loss of radiation that fails to impinge on end face 265*f* must either be accepted or the end face distorted (e.g., into an ellipse) to more closely match the dimensions of slit 502*f*.

Refer now to FIG. 11, which illustrates an exemplary output assembly to guide radiation from fiber-optic cable 265 to the imaging surface. As shown in the figure, fiber-optic cable 265 enters the assembly 270 through a retaining cap 274 (which is preferably removable). Retaining cap 274 fits over a generally tubular body 276, which contains a series of threads 278. Mounted within the forepart of body 276 are two or more focusing lenses 280*a*, 280*b*. Cable 265 is carried partway through body 276 by a sleeve 280. Body 276 defines a hollow channel between inner lens 280b and the terminus of sleeve 280, so the end face of cable 265 lies a selected distance A from inner lens 280*b*. The distance A and the focal lengths of lenses 280*a*, 280*b* are chosen so the at normal working distance from plate 55, the beam emanating from cable 265 will be precisely focused on the plate surface at a diameter optimal for imaging. This distance can be altered to vary the size of an image feature and to avoid astigmatism and aberration.

The diameter of an image feature is given by the ratio of the distance A to the distance between lens 280*a* and the surface of plate 55, multiplied by the diameter of the emitting fiber face. To increase depth-of-focus, it, may prove desirable to restrict the passage even of collimated radiation to a minimal radial extent from the central propagated ray (although the power represented by the blocked radiation will thereby be lost). In practice, the minimum necessary depth-of-focus is based on mechanical adjustment and accuracy limitations; with this quantity and the necessary degree of beam demagnification effectively fixed, the optimal beam restriction is determined primarily by the NA value of the radiation emitted at the fiber face, which is itself governed by the numerical aperture of radiation coupled into the fiber at its proximal end face 265*f*. In an exemplary embodiment, an aperture diameter of 0.109 inch provides effective results in conjunction with an NA value of 0.095. To implement this aspect of the invention, an annular wall having a selected-size orifice therethrough is interposed between lenses 280*a*, 280*b*.

Body 276 can be secured to writing array 65 in any suitable manner. In the illustrated embodiment, a nut 282 engages threads 278 and secures an outer flange 284 of body 276 against the outer face of writing array 65. The flange may, optionally, contain a transparent window 290 to protect the lenses from possible damage.

Alternatively, the lens assembly may be mounted within the writing array on a pivot that permits rotation in the axial direction (i.e., with reference to FIG. 11, through the plane of the paper) to facilitate fine axial positioning adjustment. We have found that if the angle of rotation is kept to 4° or less, the circumferential error produced by the rotation can be corrected electronically by shifting the image data before it is transmitted to controller 80.

Refer now to FIG. 12, which illustrates an alternative design in which the laser source irradiates the plate surface directly, without transmission through fiber-optic cabling. As shown in the figure, laser source 250 is seated within the rear segment of an open housing 300. Mounted within the forepart of housing 300 are two or more focusing lenses 302*a*, 302*b*, which focus radiation emanating from laser 250 onto the surface of plate 55. The housing may, optionally, include a transparent window 305 mounted flush with the open end; a heat sink 307; and the annnular wall mentioned previously, shown at reference numeral 310.

It should be understood that while the preceding discussion of imaging configurations and the accompanying figures have assumed the use of optical fibers, in each case the fibers can be eliminated through use of the embodiment shown in FIG. 12.

e. Driver Circuitry

Figure 19A:
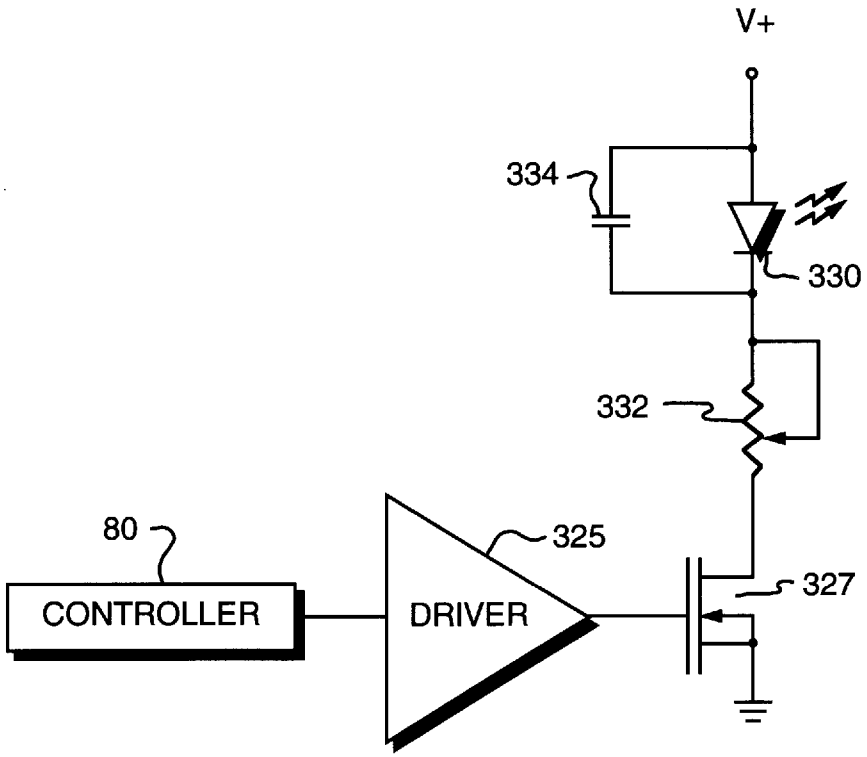
FIGS. 19A and 19B are schematic circuit diagrams of laser-driver circuits suitable for use with the present invention.

A suitable circuit for driving a diode-type (e.g., gallium arsenide) laser is illustrated schematically in FIG. 19A. Operation of the circuit is governed by controller 80, which generates a fixed-pulse-width signal (preferably 1 to 20 μsec in duration) to a high-speed, high-current MOSFET driver 325. The output terminal of driver 325 is connected to the gate of a MOSFET 327. Because driver 325 is capable of supplying a high output current to quickly charge the MOSFET gate capacitance, the turn-on and turn-off times for MOSFET 327 are very short (preferably within 0.5 μsec) in spite of the capacitive load. The source terminal of MOSFET 327 is connected to ground potential.

When MOSFET 327 is placed in a conducting state, current flows through and thereby activates a laser diode 330. A variable current-limiting resistor 332 is interposed between MOSFET 327 and laser diode 330 to allow adjustment of diode output. Such adjustment is useful, for example, to correct for different diode efficiencies and produce identical outputs in all lasers in the system, or to vary laser output as a means of controlling image size.

A capacitor 334 is placed across the terminals of laser diode 330 to prevent damaging current overshoots, e.g., as a result of wire inductance combined with low laser-diode inter-electrode capacitance.

Figure 19B:
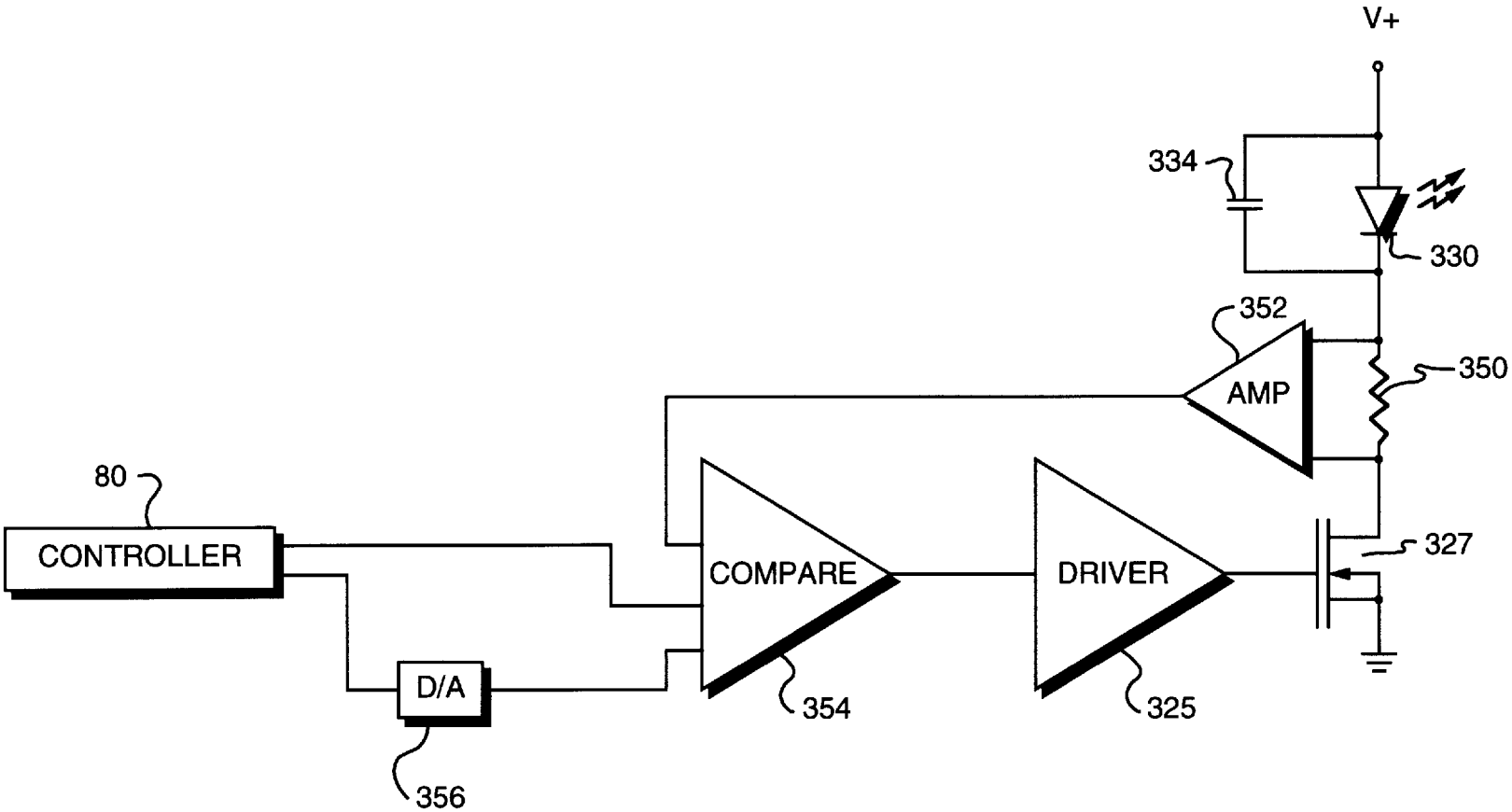

An alternative arrangement, which utilizes feedback, appears in FIG. 19B. In this case, a fixed current-limiting resistor 350 is used instead of a variable resistor, and the input terminals of an amplifier 352 are connected across this resistor. The output of amplifier 352 is connected to a first functional input terminal of a comparator 354. A second functional input terminal of comparator 354 is connected to the output of a digital-to-analog (D/A) converter 356. D/A converter 356 includes an internal latch capable of storing a digital value (provided by controller 80) corresponding to a desired diode current; the converter transforms this value into the analog output provided to comparator 354. Controller 80 directly controls the operation of comparator 354, actuating it only when diode 330 overlies plate locations at which image points are to be written.

The operation of this circuit is as follows. The voltage across resistor 350, which determines the output of amplifier 352, is proportional to the current into diode 330. When comparator 354 is operative, the circuit will supply to diode 330 that amount of current necessary to equalize the voltage at the two comparator input terminals; accordingly, the latched value dictates the maximum diode current, and the circuit prevents overshoot of this current (which might easily damage diode 330).

2. Lithographic Printing Members and Imaging Methods

Figure 20A:
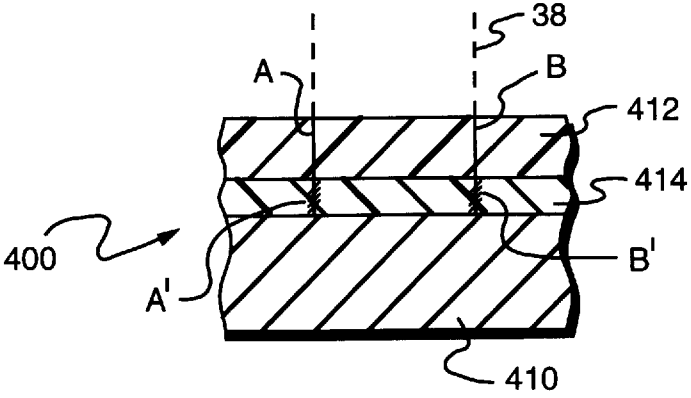
FIGS. 20A–20D are enlarged sectional views showing the manner in which suitable lithographic plate constructions are imaged in accordance with the present invention.
Figure 20B:
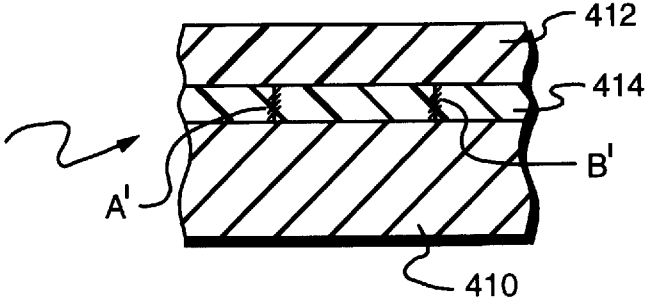
Figure 20C:
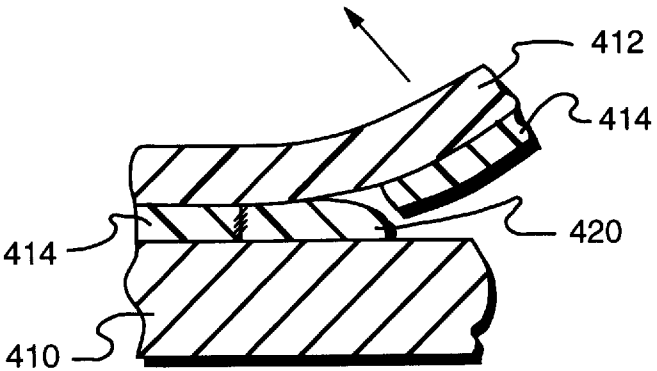
Figure 20D:
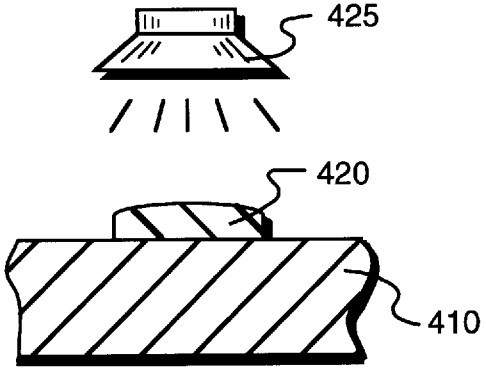

Refer now to FIGS. 20A–20C, which illustrate constructions imageable to produce lithographic printing plates, and the manner in which these constructions are imaged in accordance with the present invention. As shown in FIG. 20A, an imageable construction 400 includes a plate substrate 410 and a transfer sheet held in intimate contact therewith. The transfer sheet comprises a carrier film layer 412 that is transparent to imaging radiation and, bonded thereto, a transfer layer 414 that responds to imaging radiation in the manner described below. An imaging pulse 38 from a laser or other suitable source strikes construction 400, illuminating an area indicated by boundaries A and B.

Layers 410 and 414 (or a surface thereof) exhibit opposite affinities for ink and/or an ink-abhesive fluid. In one embodiment, directed toward production of direct-write wet plates, substrate 410 is a hydrophilic, surface-textured metal such as aluminum or chromium, and layer 414 is an oleophilic, hydrophobic, polymeric material. In related version, substrate 410 is a hydrophilic polymer, such as a polyvinyl alcohol species. In an indirect-write counterpart to this embodiment, layer 414 is a polyvinyl alcohol species, and layer 410 is an oleophilic, hydrophobic material such as a polyester primed with a vinylidenedichloride-based polymer; a useful example of such a material is Saran F-310, a vinylidenedichloride-acrylonitrile copolymer supplied by Dow Chemical Co., Midland, Mich.

In another embodiment, directed toward production of direct-write dry plates, substrate 410 is an oleophilic polymer, such as polyester, and layer 414 is an oleophobic polymer. One useful version of this embodiment includes a titanium-metallized polyester layer 410 (where the titanium is deposited to a thickness of approximately 200 Å) in conjunction with a B-staged (i.e., partially cured but still reactive) silicone donor layer 414. Titanium in its native and naturally oxidized states provides a catalytic surface that promotes further cure of the silicone during the fusing step. In an indirect-write counterpart to this embodiment, polymeric substrate 410 is oleophobic and layer 414 is the oleophilic polymer. A useful combination for this purpose is an acrylate-functional silicone (as described in U.S. Pat. Nos. 5,212,048 and 5,310,869, the entire disclosures of which are hereby incorporated by reference), employed as layer 410, and an acrylate-functional acrylate donor layer 414. Following transfer, the imaged construction is exposed to radiation, cross-linking the substrate and the transferred material.

In any case, layer 414 is formulated to interact in a controlled fashion with imaging radiation. In particular, the constructions of the present invention do not rely on creation of a gas or plasma pressure to effect the transfer of material from donor to acceptor. Instead, an imaging pulse heats the exposed portion of layer 414 to a flowable state (e.g., by melting layer 414 or raising its temperature above the glass-transition point $T_g$). In its flowable state, layer 414 exhibits a higher melt adhesion for substrate 410 than for carrier film 412, and the exposed portion of layer 414 therefore preferentially adheres to substrate 410.

Accordingly, a key feature of layer 414 is its absorption of sufficient energy from imaging pulse 38 to reach a flowable state, but not so much as to ablate. Compatibility between the absorption characteristics of layer 414 and the wavelength and power of the imaging radiation is therefore critical. Such compatibility is conveniently attained for a range of power levels by including, in layer 414, radiation absorbers that exhibit limited stability in the presence of intense imaging radiation. Alternatively, stable radiation absorbers can be employed at loading levels that render them only partially effective at absorbing imaging radiation; in this case, formulation of suitable compositions requires more detailed knowledge of the power levels likely to be applied.

Limited stability in a radiation absorber can result from vulnerability to chemical breakdown (i.e., photo-cleavage into molecular fragments having little or no absorption capacity) or thermal breakdown, or to a combination of both. Either way, the intentional self-induced failure acts as a fuse, imposing a ceiling on the temperature the transfer layer may reach in response to an imaging pulse so as to avoid unwanted ablation.

Thus, as shown in FIG. 20A, imaging pulse 38 renders flowable the material of layer 414 across a region approximating the area A–B. As a practical matter, however, the effect is not that precise, since the temperature does not decay suddenly at the boundaries. Instead, a thermal gradient, indicated at A', B', will extend into the unheated area adjacent region A–B as a result of heat conduction. Somewhere within this thermal gradient lies a viscosity transition where the layer 414 material will cease to flow. Inside this transition boundary, as shown in FIG. 20B, the material will adhere to substate 410.

The location of the separation boundary within the thermal gradient depends on the degree of internal cohesion within layer 414 and the amount of melt-adhesion preference of this layer for substrate 410 over carrier film 412. These behaviors can be altered by loading layer 414 with additives such as pigments or dyes (the latter affecting behavior to a lesser degree). Desirable additives reduce cohesion within the thermal gradient, reduce adhesion to carrier film 412 and increase adhesion to substrate 410. Typically, the mechanism by which a useful additive exerts its effects comprises interaction between pigment surfaces (or dye molecules) and the flowable polymer(s) of layer 412 that alters the binding between polymer chains and between the surfaces in contact with the polymer(s) and the polymer chains. Further effects arise from intense local heating of polymer(s) adjacent to the surface of radiation-absorptive pigment particles.

Following imagewise transfer of material from layer 414 onto substrate 410 and removal of carrier film 412 (along with untransferred material), substrate 410 (and the array of image spots 420 thereon) is subjected to a fusing step that anchors, by mechanical and/or chemical means, image spots 420 more firmly to substrate 410 (using, for example, a heating source 425 that melts image spot 420).

EXAMPLES 1–11

These examples describe preparation of positive-working wet plates in accordance with the present invention and, for comparative purposes, in accordance with prior-art techniques. The below formulations were coated on a "print-treated" polyester film, substantially transparent to imaging IR radiation, to form a transfer sheet. The print or coatability treatment promotes adhesion, and is furnished with various suitable polyester films (e.g., the J films marketed by E. I. duPont de Nemours Co., Wilmington, Del., and the MELINEX 453 film sold by ICI Films, Wilmington, Del.). Coatings were deposited using wire-wound rods and dried in a convection oven to yield final coating weights of 2 g/m$^2$.

The prepared transfer sheets were brought into intimate contact with aluminum substrates, each 0.006 inch in thickness and having grained, anodized and silicated surfaces, and mechanically clamped together at the edges. (It should be understood that many alternative approaches, e.g., vacuum and electrostatic binding, are available and well known to those skilled in the art.) The resulting constructions were imaged in accordance with the techniques hereinbefore described to transfer the material, following which they were fused by heating at 300° F. for 1 min. (equivalent results can be obtained by heating at 400° F. for 0.5 min.).

The following formulations were used to produce transfer layers:

| | Example | | | | | | | | | | |
|---|---|---|---|---|---|---|---|---|---|---|---|
| Component | 1 | 2 | 3 | 4 | 5 | 6 | 7 | 9 | 9 | 10 | 11 |
| | | | | Weight % | | | | | | | |
| 5–6" Rs Nitrocellulose | 12.5 | 12.5 | 12.5 | 12.5 | — | — | — | 2.5 | 2.5 | 2.5 | 2.5 |
| Acryloid B-44 | — | — | — | — | 12.5 | 12.5 | 12.5 | 10.0 | 10.0 | 10.0 | 10.0 |
| Vulcan XC-72 | 11.0 | 8.0 | — | — | 8.0 | — | — | — | — | 8.0 | 9.0 |
| Heliogen Green L 8605 | — | — | 8.0 | — | — | — | 8.0 | — | 8.0 | — | — |
| Kodak IR-810 | — | 3.0 | 3.0 | 3.0 | — | 3.0 | 3.0 | 3.0 | 3.0 | 3.0 | — |
| Methyl ethyl ketone | 76.5 | 76.5 | 76.5 | 84.5 | 79.5 | 84.5 | 76.5 | 76.5 | 76.5 | 76.5 | 79.5 |
| | | | | Results | | | | | | | |
| Transfer | Yes | Yes | Inc. | Yes | Yes | Yes | Yes | Yes | Yes | Incomplete | |
| Gas Pockets | Yes | Yes | Severe | Yes | No | No | No | Severe | No | Yes | |
| Adhesion to Substrate | Yes | Yes | Yes | Yes | No | Yes | Yes | Yes | Yes | No | |
| Film Split | Yes | Yes | No | Minor | — | No | No | No | No | — | |
| Plate Life Test | — | — | — | — | — | Pass | Pass | Fail | Fail | — | |

The nitrocellulose utilized was the 30% isopropanol wet 5–6 Sec RS Nitrocellulose supplied by Aqualon Co., Wilmington, Del. Acryloid B-44 is an acrylic resin supplied by Rohm & Haas, Philadelphia, Pa. Vulcan XC-72 is a conductive carbon black pigment supplied by the Special Blacks Division of Cabot Corp., Waltham, Mass. Kodak IR-810 is an IR-absorbing dye obtained from Eastman Fine Chemicals, Eastman Kodak Co., Rochester, N.Y.

Heliogen Green L 8730 is a green pigment supplied by BASF Corp., Chemicals Division, Holland, Mich.

In these examples, "transfer" indicates whether sufficient amounts of material transferred to the substrate to facilitate imaging (the notation "Inc." indicating incomplete transfer). "Gas pockets" refers to the above-described condition resulting from accumulation of ablation-created gas(es), and which produces uneven or missing transfer. None of the examples exhibited substantial adhesion to the substrate prior to the heat-fusion step. "Film split" measures the cohesive strength of the transferred and heat-fused coatings. The film-split test is performed by affixing adhesive tape to the finished plate and then withdrawing the tape; deposition of material onto the tape indicates weak interior adhesion. The plates were subjected to 50,000 impressions, and the results of the plate life test indicate whether the plate remained usable after this degree of wear.

Examples 1–4 are coatings formulated along lines known from the prior art. All contain a self-oxidizing nitrocellulose binder; Examples 1 and 2 utilize carbon-black pigment. Example 1 utilizes the pigment alone, Examples 2 and 3 an IR-absorptive dye in combination therewith, and Example 4 an IR-absorptive dye alone. None of these formulations is useful in the context of the present invention. Replacement of carbon black with a different pigment (as in Example 3) and even its complete replacement by an IR-absorptive dye (as in Example 4) fails to overcome problems arising from gas pockets.

Example 5 eliminates the self-oxidizing nitrocellulose binder but reintroduces carbon black; this formulation also exhibits gas pockets and is likewise unsuitable. Example 6, which avoids both carbon black and self-oxidizing binders, represents a coating formulation suitable for use with the present invention.

Example 7 exemplifies a second category of useful formulation containing a pigment that absorbs IR imaging radiation only weakly, if at all, and an IR-absorptive dye. In Example 7, the green pigment is relatively non-absorptive in the near-IR region but serves to beneficially modify transfer properties.

Example 8 shows that formulations based on another traditional ablation-transfer material, nitrocellulose, produce undesirable gas pockets. However, when combined at low levels with a particulate filler that suppresses formation of gas pockets (e.g., by adsorption or absorption, or reaction with the gas), nitrocellulose can be employed to advantage.

Once again, however, using carbon black as the particulate filler, as in Examples 10 and 11, renders otherwise worthwhile material unusable.

EXAMPLES 12–21

| Component | Example 12 | 13 | 14 | 15 | 16 | 17 | 18 | 19 | 20 | 21 |
|---|---|---|---|---|---|---|---|---|---|---|
| | Weight % | | | | | | | | | |
| 5–6" RS Nitrocellulose | 12.5 | — | — | — | — | — | — | — | — | — |
| Acryloid B-44 | — | 12.5 | 12.5 | 12.5 | 12.5 | 12.5 | 12.5 | — | — | — |
| Estane 5715 | — | — | — | — | — | — | — | 12.5 | 12.5 | — |
| Vitel PE-200 | — | — | — | — | — | — | — | 12.5 | — | — |
| Vulcan XC-72 | 1.0 | 1.0 | 1.0 | — | — | — | — | — | — | — |
| Kodak IR-810 | — | — | 1.0 | 3.0 | 3.0 | 3.0 | — | 3.0 | 3.0 | 3.0 |
| Titanyl phthalocyanine | — | — | — | — | — | — | 4.0 | — | — | — |
| Heliogen Green L 8605 | — | — | — | 4.0 | — | — | — | — | 4.0 | — |
| Hostaperm Blue A2R | — | — | — | — | 4.0 | — | — | — | — | — |
| Orasol Black RLI | — | — | — | — | — | 4.0 | — | — | — | — |
| Methyl ethyl ketone | 87.5 | 87.5 | 87.5 | 80.5 | 80.5 | 80.5 | 83.5 | 84.5 | 84.5 | 84.5 |
| | Results | | | | | | | | | |
| Transfer | Yes | Yes | Yes | Yes | Yes | Yes | Yes | Marg. | Yes | Yes |
| Gas Pockets | No | No | No | No | No | No | No | No | No | No |
| Adhesion to Substrate | Yes | Yes | Yes | Yes | No | Yes | Yes | Yes | Yes | Yes |
| Film Split | No | No | No | No | No | No | No | No | No | No |
| Plate Life Test | Fail | Fail | Pass | Pass | Pass | Pass | Pass | — | Pass | Pass |

Estane 5715 is a polyurethane polymer obtained from The BF Goodrich Co., Cleveland, Ohio. Vitel PE-200 is a polyester polymer obtained from Goodyear Tire & Rubber Co., Akron, Ohio. Hostaperm Blue A2R is a blue pigment supplied by the Specialty Chemicals Group, Hoechst Celanese Corp., Charlotte, N.C. Orasol Black RLI is an IR-absorptive dye obtained from the Pigments Division, Ciba-Geigy Corp., Newport, Del.

Examples 12 and 13 represent attempts to improve the unacceptable performance of the coating of Example 1 by lowering the carbon-black content and, in Example 13, replacing the potentially self-oxidizing nitrocellulose with an acrylic polymer. While gas pockets and film split are overcome, the transferred coatings lack the durability necessary for commercially realistic printing runs. Thus transfer materials based solely on carbon black, even at low concentrations and in the absence of self-oxidizing binders, are unsuitable for the present invention. In particular, Example 13 suggests that the localized "hot spots" produced by irradiation of the highly stable carbon-black particles diminish durability, either by local degradation by ablation of the immediately surrounding polymer, non-uniform heating of the bulk transfer material, or some combination of these mechanisms.

In Example 14, an IR-absorbing dye is added to the formulation of Example 13. The result is a plate that passes the 50,000-impression test. The inclusion of a soluble dye, which absorbs at the molecular (as opposed to particle) level and is evenly dispersed throughout the absorptive transfer material, promotes highly even heating of that layer by laser pulses. It appears, therefore, that uniform heating is important to production of durable coatings with the present invention, and that the lack of this response primarily accounts for the poor durability characteristics exhibited by the Example 13 formulation.

Example 15 represents a variation of the Example 7 formulation, in which the amount of pigment has been reduced. Taken together, the two examples illustrate the ability to vary pigment loading fractions while maintaining desired properties.

In Example 16, we substituted a blue pigment (also a weak IR absorber) for the Heliogen Green pigment of Example 4. We anticipate that a range of pigments that advantageously modify transfer properties will be usable in the context of the present invention.

An IR-absorptive phthalocyanine pigment was used in Example 18. Unlike carbon black, this pigment is thermally unstable. The success of this formulation may also be due to use of the pigment in small enough amounts to avoid overheating.

In Example 17, we replaced the Heliogen Green pigment of Example 4 with a soluble dye. This approach is advantageous where the need for property modification, as can be achieved using pigments, is not present: dissolving a dye involves considerably less manufacturing inconvenience than dispersing a pigment.

In Examples 19 and 20, we replaced the acrylic polymer of Example 4 with a polyurethane polymer. Although the transfer properties of the resulting material suffer using the IR-810 pigment, performance improves substantially with the substitution of Heliogen Green. Once again, these examples demonstrate the considerable variation in physical properties that may be obtained using different types and amounts of pigments.

Example 21 represents another variation of the Example 4 formulation, illustrating that advantageous results are obtainable with yet another class of polymer base (in this case polyester).

EXAMPLES 22–25

The following examples illustrate cross-linking as a fusing mechanism following transfer.

| Component | Example 22 | 23 | 24 | 25 |
|---|---|---|---|---|
| | Weight % | | | |
| Acryloid B-44 | 12.5 | 12.5 | — | — |
| Dianal BR-87 | — | — | 12.5 | — |
| Estane 5715 | — | — | — | 12.5 |
| Kodak IR-810 | 3.0 | 3.0 | 3.0 | 3.0 |
| Heliogen Green L 9605 | — | 4.0 | — | — |
| Cymel 303 | 3.0 | 3.0 | 3.0 | 2.0 |

-continued

| Component | Example 22 | 23 | 24 | 25 |
|---|---|---|---|---|
| NaCure 2530 | 4.0 | 4.0 | 4.0 | 3.0 |
| Methyl ethyl ketone | 77.5 | 73.5 | 77.5 | 75.5 |
| | Results | | | |
| Transfer | Marg. | Yes | Yes | Yes |
| Gas Pockets | No | No | No | No |
| Adhesion to Substrate | Yes | Yes | Yes | Yes |
| Film Split | No | No | No | No |
| Plate Life Test | — | Pass | Pass | Pass |

NaCure 2530, supplied by King Industries, Norwalk, Conn., is an amine-blocked p-toluenesulfonic acid solution in an isopropanol/methanol blend. Cymel 303 is hexamethoxymethylmelamine, supplied by American Cyanamid Corp. Dianal BR-87 is an acrylic copolymer supplied by Dianal America, Inc., Pasadena, Tex., in which the major component is methyl methacrylate and the minor component is methacrylic acid.

To prepare the coatings, the various components, including the blocked PTSA catalyst, were combined and the resulting mixtures applied to an aluminum substrate using a wire-wound rod. The coatings were allowed to dry without heating to yield final coating weights of 2 g/m$^2$.

Following imagewise transfer of the material onto the aluminum substrates, the substrates were cured by heating for 1 min. at 300° F. in a convection oven. In Examples 22–24, curing was by self-condensation of the melamine resin. In Example 25, the melamine cross-linked with hydroxyl groups present on the polyurethane polymer.

The addition of Cymel 303 and the catalyst lowered the $T_g$ and adhesion characteristics otherwise associated with Acryloid-based formulations. Accordingly, in Example 23, the Heliogen Green pigment was added to the Example 22 formulation to beneficially modify physical characteristics and thereby achieve better transfer properties. Example 24 illustrates use of a polymer with carboxyl functional groups that promote adhesion with the aluminum substrate, and which are not consumed by cross-linking reactions.

Still other cross-linking systems can also be utilized. For example, the base polymer (e.g., Acryloid B-44) can include epoxy functional groups; in this case, the formulation will include a $BF_3$-amine complex that may be thermally activated following imaging. It is also possible to utilize radiation-cure materials, although, if the post-transfer heating step is omitted in connection with a textured substrate, the benefits of mechanical locking will be lost. Suitable radiation-cure coatings will be largely unreactive with imaging radiation; for example, acrylate-functional materials are useful in conjunction with near-IR imaging radiation; these may be cured directly by electron-beam exposure, or may incorporate a photoinitiator for cure by exposure to ultraviolet radiation.

It will therefore be seen that we have developed a highly versatile approach to automated production of lithographic printing members by non-ablative transfer. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of producing a lithographic printing member using non-ablative radiation-induced material transfer, the method comprising the steps of:

a. providing a donor blank comprising a layer of transfer material disposed on a carrier layer, the carrier layer being substantially transparent to imaging radiation and the transfer material becoming flowable but not ablating in response to imaging radiation, the transfer material comprising at least one absorber of imaging radiation, the absorber being (i) a limited-stability absorber that ceases absorbing before the transfer layer can ablate, or (ii) present in an amount that prevents absorption of sufficient imaging radiation to cause the transfer layer to ablate;

b. providing an acceptor substrate, the transfer material and the acceptor substrate having different affinities for at least one printing liquid selected from the group consisting of ink and an abhesive fluid for ink, and the transfer material exhibiting, in its flowable state, preferential adhesion for the acceptor substrate relative to the carrier layer;

c. causing intimate contact between the transfer layer and the acceptor substrate;

d. imagewise irradiating the transfer layer through the carrier layer so as to cause imagewise displacement of the transfer material to the acceptor substrate;

e. removing the carrier layer and unirradiated transfer material from the acceptor substrate; and f. heating the displaced transfer material to enhance adhesion with the acceptor substrates.

2. The method of claim 1 wherein the transfer material is oleophobic and the acceptor substrate is oleophilic.

3. The method of claim 1 wherein the substrate has a texture and heating of the displaced transfer material causes it to flow into the texture.

4. The method of claim 1 wherein the transfer material comprises at least one cross-linkable component and heating of the displaced transfer material causes the cross-linkable component to cross-link.

5. The method of claim 1 wherein the irradiation is accomplished using near-IR radiation.

6. The method of claim 1 wherein the irradiation is accomplished using at least one laser source.

7. The method of claim 1 wherein the irradiation is accomplished by light valving.

8. The method of claim 1 wherein irradiation melts the transfer layer.

9. The method of claim 1 wherein the transfer material has a glass-transition temperature and irradiation heats the transfer material above said temperature.

10. The method of claim 1 wherein the transfer material is oleophilic and the acceptor substrate is hydrophilic.

11. The method of claim 1 wherein the transfer material is hydrophilic and the acceptor substrate is oleophilic.

12. The method of claim 1 wherein the transfer material is oleophilic and the acceptor substrate is oleophobic.

13. Printing apparatus comprising:

a. at least one print station including:

i. a plate cylinder;

ii. a printing member comprising (A) a donor blank comprising a layer of transfer material disposed on a carrier layer, the carrier layer being substantially transparent to imaging radiation and the transfer material becoming flowable, but not ablating, in response to imaging radiation, the transfer material comprising at least one absorber of imaging radiation, the absorber being (1) a limited-stability absorber that ceases absorbing before the transfer layer can ablate, or (2) present in an amount that prevents absorption of sufficient imaging radiation to cause the transfer layer to ablate, and (B) an acceptor substrate, the transfer material and the acceptor substrate having different affinities for at least one printing liquid selected from the group consisting of ink and an abhesive fluid for ink, and the transfer material exhibiting, in its flowable state, preferential adhesion for the acceptor substrate relative to the carrier layer;

iii. means for causing intimate contact between the donor blank and the acceptor substrate;

iv. means for supporting the printing member;

v. at least one source of imaging radiation focused on the transfer material;

vi. means for causing relative movement between the radiation source and the support means to imagewise expose the transfer material to the imaging radiation, thereby causing imagewise displacement of the transfer material to the acceptor substrate; and vii. means for heating the displaced transfer material to enhance adhesion with the acceptor substrate; and b. means for transferring a recording medium to the print station.

14. A method of printing with a printing press that includes a plate cylinder, the method comprising the steps of:

a. providing a donor blank comprising a layer of transfer material disposed on a carrier layer, the carrier layer being substantially transparent to imaging radiation and the transfer material becoming flowable but not ablating in response to imaging radiation, the transfer material comprising at least one absorber of imaging radiation, the absorber being (i) a limited-stability absorber that ceases absorbing before the transfer layer can ablate, or (ii) present in an amount that prevents absorption of sufficient imaging radiation to cause the transfer layer to ablate;

b. providing an acceptor substrate, the transfer material and the acceptor substrate having different affinities for at least one printing liquid selected from the group consisting of ink and an abhesive fluid for ink, and the transfer material exhibiting, in its flowable state, preferential adhesion for the acceptor substrate relative to the carrier layer;

c. causing intimate contact between the transfer layer and the acceptor substrate;

d. mounting the donor blank on the plate cylinder;

e. imagewise irradiating the transfer layer through the carrier layer so as to cause imagewise displacement of the transfer material to the acceptor substrate;

f. removing the carrier layer and unirradiated transfer material from the acceptor substrate;

g. heating the displaced transfer material to enhance adhesion with the acceptor substrate and thereby create a working printing member;

h. applying ink to the printing member; and i. transferring the ink to a recording medium.

15. Printing apparatus comprising:

a. a printing member comprising:

i. a donor blank comprising a layer of transfer material disposed on a carrier layer, the carrier layer being substantially transparent to imaging radiation and the transfer material becoming flowable, but not ablating, in response to imaging radiation, the transfer material comprising at least one absorber of imaging radiation, the absorber being (i) a limited-stability absorber that ceases absorbing before the transfer layer can ablate, or (ii) present in an amount that prevents absorption of sufficient imaging radiation to cause the transfer layer to ablate; and ii. an acceptor substrate, the transfer material and the acceptor substrate having different affinities for at least one printing liquid selected from the group consisting of ink and an abhesive fluid for ink, and the transfer material exhibiting, in its flowable state, preferential adhesion for the acceptor substrate relative to the carrier layer;

b. means for causing intimate contact between the donor blank and the acceptor substrate;

c. means for supporting the printing member;

d. at least one source of imaging radiation focused on the transfer material;

e. means for causing relative movement between the radiation source and the support means to imagewise expose the transfer material to the imaging radiation, thereby causing imagewise displacement of the transfer material to the acceptor substrate; and f. means for heating the displaced transfer material to enhance adhesion with the acceptor substrate.

16. The apparatus of claim 15 wherein the acceptor substrate is hydrophilic and the transfer material is oleophilic.

17. The apparatus of claim 16 wherein the acceptor substrate is a textured metal.

18. The apparatus of claim 17 wherein the metal is grain-anodized aluminum.

19. The apparatus of claim 17 wherein the metal is chromium.

20. The apparatus of claim 16 wherein the acceptor substrate is a polyvinyl alcohol chemical species.

21. The apparatus of claim 15 wherein the acceptor substrate is is oleophilic and the transfer material is hydrophilic.

22. The apparatus of claim 15 wherein the acceptor substrate is oleophilic and the transfer material is oleophobic.

23. The apparatus of claim 22 wherein the acceptor substrate is polyester.

24. The apparatus of claim 15 wherein the acceptor substrate is oleophobic and the transfer material is oleophilic.

25. The apparatus of claim 15 wherein the source of imaging radiation is a light-valving assembly.

26. The apparatus of claim 15 wherein the absorber is a limited-stability absorber that ceases absorbing before the transfer layer can ablate.

27. The apparatus of claim 15 wherein the absorber comprises at least one pigment.

28. The apparatus of claim 15 wherein the absorber comprises at least one chromophore chemically integrated within the transfer layer.

29. The apparatus of claim 15 wherein the absorber comprises at least one pigment.

30. The apparatus of claim 29 wherein the transfer material further comprises a pigment that does not significantly absorb imaging radiation.

31. The apparatus of claim 15 wherein the absorber is present at in an amount that prevents absorption of sufficient imaging radiation to cause the transfer layer to ablate.

32. The apparatus of claim 15 wherein the source of imaging radiation is at least one laser.

* * * * *